US005528477A

United States Patent [19]

Carmo

[11] Patent Number: 5,528,477

[45] Date of Patent: Jun. 18, 1996

[54] PORTABLE FLUORESCENT WORK LIGHT

[75] Inventor: Robert A. Carmo, Placentia, Calif.

[73] Assignee: Pacific Electricord Company, Gardena, Calif.

[21] Appl. No.: 307,994

[22] Filed: Sep. 16, 1994

[51] Int. Cl.[6] ..... F21S 3/00

[52] U.S. Cl. ..... 362/260; 362/396; 362/376

[58] Field of Search ..... 362/260, 396, 362/285, 362, 225, 390, 369, 255, 376, 377

[56] References Cited

U.S. PATENT DOCUMENTS

| | | | |
|---|---|---|---|
| 4,092,706 | 5/1978 | Vest | 362/390 |
| 4,426,327 | 4/1981 | Kovacik et al. | 362/362 |
| 4,958,267 | 9/1990 | Baake | 362/260 |
| 5,243,505 | 9/1993 | Carr | 362/376 |
| 5,245,518 | 9/1993 | Aspenwall | 362/260 |

*Primary Examiner*—Denise L. Gromada
*Assistant Examiner*—Sara Sachie Raab
*Attorney, Agent, or Firm*—Paul J. Sutton

[57] ABSTRACT

A fluorescent work light assembly employing a twin tube fluorescent bulb which is interconnected at a second end and has one contact for each tube at a first end to place the bulb in series with a source of AC power. The bulb is mounted in a protective envelope tube with supports adjacent both ends to position and support the bulb. And end cap at the second end permits the light member to be suspended adjacent a work area. An end cap at the first end permits a power source to be connected via a two position switch to the bulb pins. Both end caps are assembled to the protective envelope stop members and have members which also permit the end caps to be assembled. A ballast device is placed in the work light assembly itself.

42 Claims, 7 Drawing Sheets

PORTABLE FLUORESCENT WORK LIGHT

BACKGROUND OF THE INVENTION

1. Field of the Invention

The invention is directed to portable work lights and more particularly to potable work lights employing fluorescent tubes which can be suspended adjacent a work area.

2. Description of the Prior Art

The usual work lights found in the prior art consist of an incandescent bulb mounted in a socket surrounded by a cage constructed of metal wires welded, braised or otherwise joined or of a cage molded entirely of plastic or rubber. These cages are intended to protect the lamp bulb from damage by limiting access to them. The bulbs are also susceptible to damage due to shock when dropped or struck against or by some object. Certain specialized "rough service" bulbs are offered which are asserted to be less susceptible to shock damage. In use incandescent bulbs, provide a limited area of lighting and give off a great deal of heat requiring placement of the lap at some distance from the work area thereby decreasing the light available a such work area.

Fluorescent lamp bulbs have a number of distinct advantages over incandescent lamp bulbs of the same rated wattage. The fluorescent lamp bulbs give off more light, produce less heat and glare and will last for a longer period of time. Also, the fluorescent lamp will illuminate a larger area and because of its cool operation may be placed closer to the work area.

However, adapting the usual straight robe fluorescent lamp bulb for use as a work light has a created a number of problems associated with the rather flimsy end cap and contact pins mounted thereon located at each end of the tube. Available fluorescent lamp bulb sockets are not able to maintain, throughout the bulb's serviceable life, a good electrical connection with the bulb end pins. Even a good initial connection between the bulb pins and the bulb socket does not guarantee a continued good contact therebetween as the bulb/socket combinations are subjected to rough use in the field. Without good contact the fluorescent bulb may not light or if it does it will result in a dangerous high impedance joint.

In order to overcome the contact problems between the bulb pins and the sockets. the sockets have been made larger and stronger which makes them difficult to use on a portable light source where weight is a considerable factor.

Also, in order to protect the fluorescent bulb, a plastic tube is usually placed about such fluorescent bulb which introduces problems of thermal expansion of the plastic tube if one or both of the bulb sockets is mounted upon the plastic tube. The U.S. Pat. No. 4,092,706 to Vest discloses a fluorescent light designed to accommodate elongation of a plastic tube due to thermal expansion of such plastic tube upon which the tube sockets are mounted. A metal four-legged socket support with a flexible inner leg is employed to maintain electrical contact with the fluorescent tube despite changes in the length of such plastic tube.

A further problem exists with a portable fluorescent bulb device. That is, that electrical connections must be made to both ends of the fluorescent bulb. The fluorescent bulb could be placed mid-span of the electrical conductors powering the bulb or the bulb could be placed at the conductor ends with one or more conductors passing over or within the support plastic robe of the portable fluorescent bulb. In U.S. Pat. No. 4,088,882 to Lewis, he shows a fluorescent lamp unit for a bicycle in which the end caps are adhesively bonded to the ends of the fluorescent bulb to establish and maintain a good electrical connection between the bulb pins and the socket. In addition, one conductor extends between the bulb end caps as a helix over the face of the bulb itself where it is subject to damage or full or partial removal from the respective end caps.

U.S. Pat. No. 4,262,327 to Kovacik shows a portable fluorescent tube work light having an outer tubular envelope about the fluorescent tube with end sockets at both ends. Conductors 106, 107 extend from one end of the fluorescent tube to the other within the tubular envelope and adjacent to and most likely in direct contact with the fluorescent tube. Despite its lower generation of heat as compared to an incandescent lamp, the heat in a confined space may be sufficient to destroy the insulation on the two conductors and cause the fluorescent tube and its associated circuits to be shorted out or otherwise affected.

SUMMARY OF THE INVENTION

The instant invention overcomes the shortcomings of the known prior art devices by providing a portable fluorescent tube work light which employs a twin-tube fluorescent bulb in which the number of contacts is reduced to two from the present four and wherein both contacts are located on the same bulb end whereby the need for internal or external conductors from one end of the bulb to the other is eliminated and the individual contacts made simple to apply and provide a good electrical and mechanical joint between the bulb contacts and the electrical leads without regard to the length of service or the roughness of its use.

The twin-tube is placed in a plastic outer tubular envelope and supported at both ends by mounting rings. The plastic envelope and the twin-tube are free to expand and contract individually without impact on the other. The electrical connections to the twin-tube from the switch located beyond the envelope are able to compensate for relative dimensional changes between the twin-tube and the plastic envelope. The mounting rings provide shock isolation for the twin-tube within the envelope. By the use of small contact pins and slide-on pin connectors, the overall weight of the lamp portion of the device is minimized. It is an object of this invention to provide a novel portable fluorescent work light.

It is an object of this invention to provide a novel portable fluorescent work light employing a fluorescent twin-tube bulb.

It is yet another object of this invention to provide a novel portable fluorescent work light with all electrical connections to the fluorescent bulb at one end of such bulb.

It is still another object of the invention to provide a novel portable fluorescent work light wherein the fluorescent bulb and its outer tubular envelope are so isolated from one another so that the expansion or contraction of the envelope and bulb do not affect the tube mounting or electrical connections thereto.

Other objects and features of the invention will be pointed out in the following description and claims and illustrated in the accompanying drawings, which disclose, by way of example, the principles of the invention, and the best mode presently contemplated for carrying it out.

BRIEF DESCRIPTION OF THE DRAWING

In the drawings in which similar elements are given similar reference characters.

DESCRIPTION OF THE PREFERRED EMBODIMENT

Figure 1:
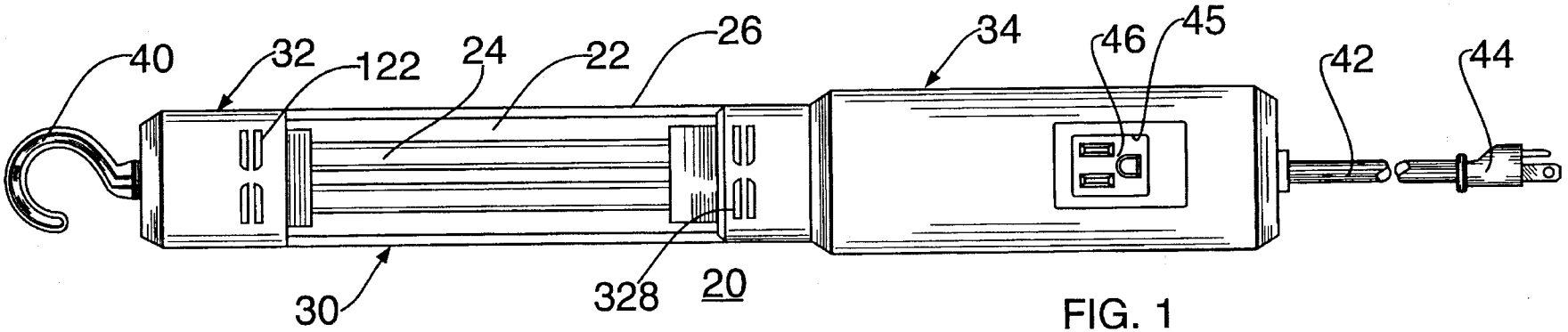
FIG. 1 is a top plan view of a portable fluorescent work light constructed in accordance with the concepts of the invention.
Figure 2:
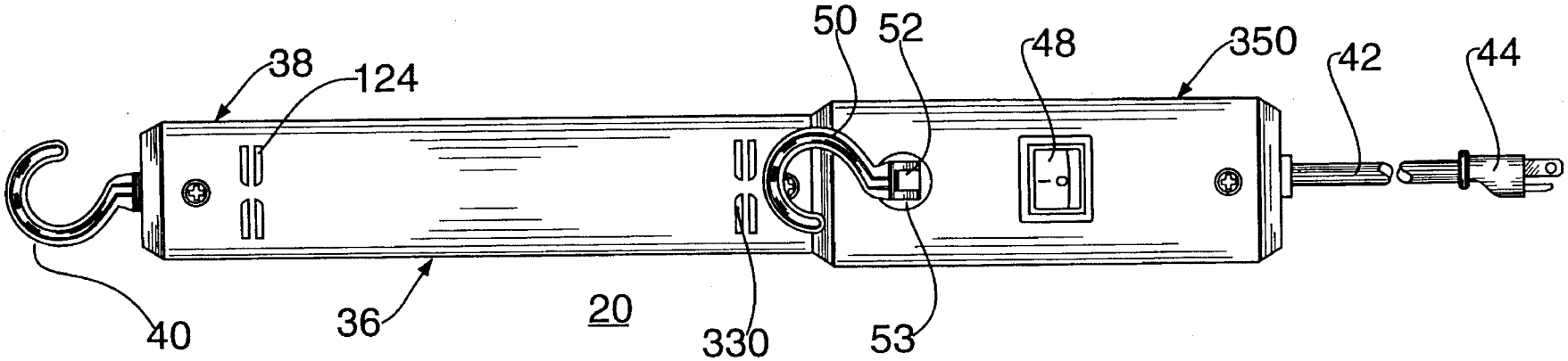
FIG. 2 is a bottom plan view of the fluorescent work light shown in FIG. 1.
Figure 12:
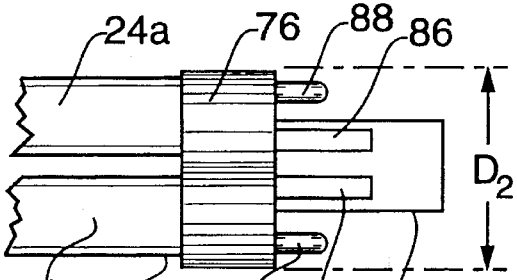
FIG. 12 is a fragmentary side elevational view of the end of the twin-tube assembly of FIG. 11 with the mount removed so that the details of the twin-tube can be better appreciated.
Figure 13:
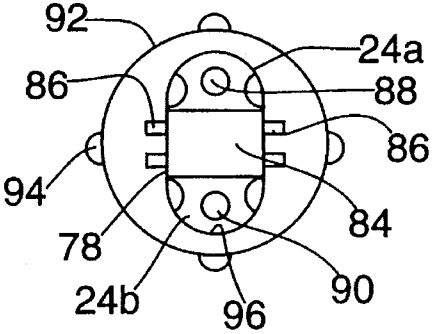
FIG. 13 is an end elevational view of the twin-tube and mount of FIG. 10.

Turning now to FIGS. 1 and 2 there is shown a portable fluorescent work light 20 constructed in accordance with the concepts of the invention. Light assembly 22 (See FIG. 10) contains a twin tube fluorescent bulb 24 rated at 13 watts and which can be obtained from the Twin Tube Lamp Center, 24500 Solon Road, Bedford Heights, Ohio 44116. The twin tube or bulb 24 is positioned inside of a plastic tubular envelope 26 having an interior diameter $D_1$ (see FIG. 10) greater than the twin tube plug end exterior diameter $D_2$ (FIG. 12). A portion of the interior periphery of the envelope 26 can be covered with a reflective material on a backing such as 28 (see FIG. 14) or coated with a reflective layer such as white paint, silver paint, reflective tape, reflective foil or the like to limit the portion of the envelope 26 through which light is emitted and to focus the light striking the reflective layer 28 to the non-reflective portion of the envelope thus increasing the effective light available from light assembly 22.

Fluorescent work light 20 is made up of two housing portions, a first housing portion 30 is made up of a first end cap 32, the light assembly 22 and a second end cap 34. The second housing portion 36 is a unitary member having portions which cooperate with first end cap 32, light assembly 22 and second end cap 34, as will be set forth below. Captured within the end of first end cap 32 and second housing portion 36 is a hook 40 which can be used to suspend work light 20 adjacent the work site. Hook 40 is so mounted that it is first to rotate a full 360° to position the light as desired. The three conductor electrical cord 42, having a plug 44 at a first end can be plugged into any suitable source of AC power (not shown). The cord 42 enters between housing portions 34 and 36 through a strain relief as will be described below. The cord 42 is connected to a convenience three-prong outlet 46 and an on/off switch 48 and the twin-tube assembly 22. An additional hook 50 is mounted in a freely rotatable mount 52 which permits hook 50 to rotate a full 360° in a plane perpendicular to the longitudinal axis of the work light 20 and a full 180° in the plane of the longitudinal axis.

Figure 9:
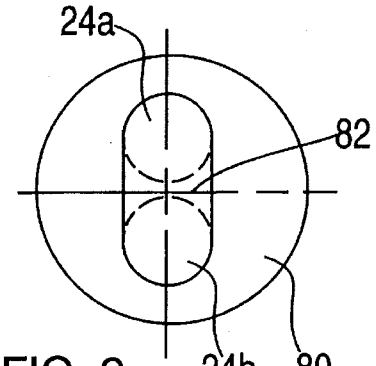
FIG. 9 is a front elevational view of the twin-tube mount of FIG. 8.
Figure 8:
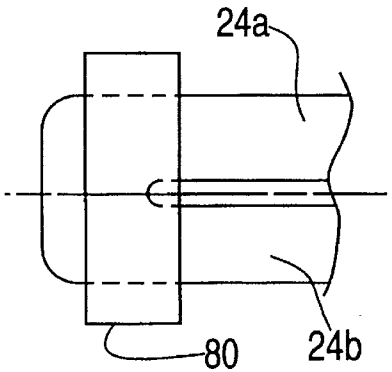
FIG. 8 is a fragmentary side elevation showing a portion of a twin-tube mounted in first end support.
Figure 10:
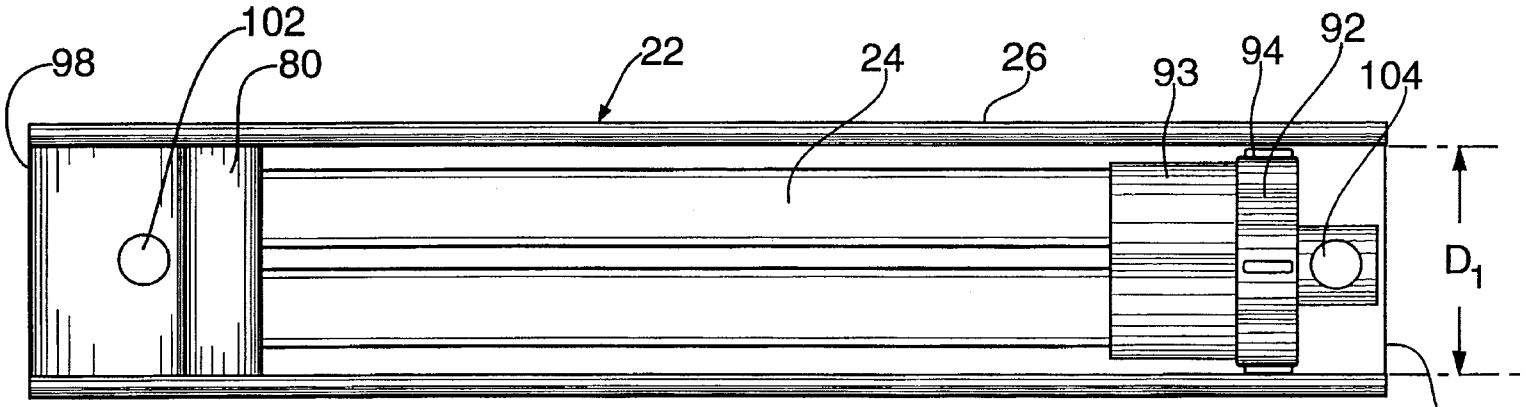
FIG. 10 is a top plan view of the twin-tube assembly of the device of FIG. 1.
Figure 11:
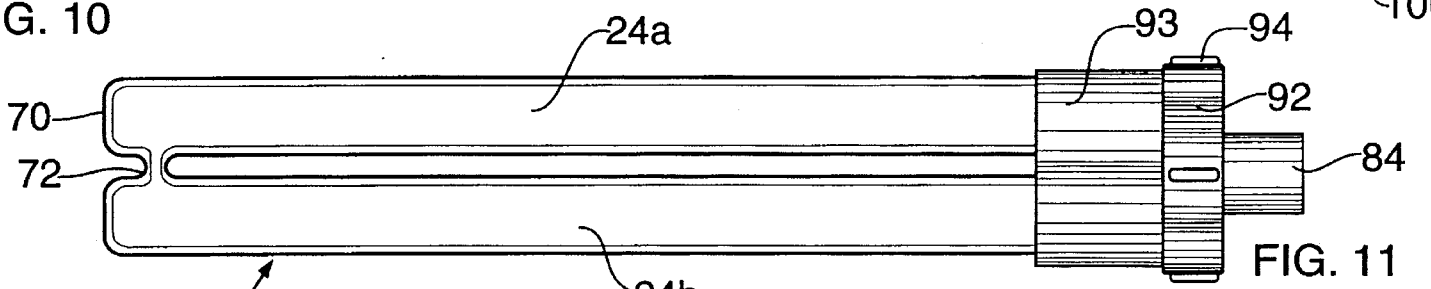
FIG. 11 is a top plan view of the twin-tube assembly of FIG. 10 with the outer plastic envelope removed.

Turning now to FIGS. 8, 9, 10, 11, 12 and 13 the details of twin tube 24 and its mounting within tubular envelope 26 can be appreciated. Twin tube 24 as shown in FIG. 11 is made up of two separate tubes **24*a* and 24*b* joined adjacent a first end 70 by a bridge member 72 which contains a passage (not shown) between the interior of tubes 24*a* and 24*b* so that there is a complete gas path between tubes 24*a* and 24*b*. To support and position twin tube 24 adjacent first end 70 a ring 80, as shown in FIG. 8, 9 and 10 is employed. The ring 80 is made of a compressible material such as sponge robber, foamed material, elastomeric or the like having a diameter in excess of the interior diameter $D_1$ of envelope 26. An elongate aperture 82 (see FIG. 9) in the ring 80 is somewhat smaller than the twin tube 24. The twin tube 24 end 70 is placed in aperture 82 causing it to dilate slightly. The twin tube 24 with ring 80 in place is then inserted into the envelope 26 causing it to be compressed and assuring that the twin tube 24 is tightly held by ring 80 and ring 80 tightly contacts the interior surface of envelope 26. This action supports end 70 of twin tube 24, positions end 70 with respect to envelope 26 and provides twin tube 24 with isolation from shocks that the envelope 26 is subjected to. When end cap 32 is positioned on tube 26, ring 80 is substantially within such end cap 32 to minimize light loss, although it may be placed elsewhere on the twin tube 24**.

At the second end 74 of the tubes **24*a*, 24*b* is a support 76 having an elongate profile outer surface 78 (see FIG. 13) and a barrier 84 having ridges 86 on both sides. Tubes 24*a*, 24*b* are sealed to support 76 and a single pin 88 connects with tube 24*a* while a single pin 90 connects with tube 24*b***.

To match the outer surface 78 of support 76 to the interior diameter $D_1$ of tubular envelope 26, a second support ring 92 is employed. Ring 92 is generally circular and has four projections 94 spaced equally about its outer surface. The outer diameter of ring 92 measured at the tops of projections 94 is slightly greater than envelope 26 interior diameter $D_1$ causing slight compression of ring 92 to assure a good mechanical connection between the projections 94 of ring 92 and the interior surface of envelope 26. Ring 92 also has an elongate aperture 96 which receives the elongate surface 78 of support 76. The compression of ring 92 also improves the mechanical joint between ring 92 and support 76. Ring 92 also has an extension 93 to further support the tube 24. Ring 92 may be formed of nylon, or any other thermoset or thermoplastic material with a sufficient modulus of elasticity. Adjacent end 98 of envelope 26 is a through aperture 102 which passes through both sides of envelope 26 in a straight line. Similiarly adjacent end 100 of envelope 26 is a through aperture 104 which passes through both sides of envelope 26 in a straight line.

The light assembly 22 is closed and surrounded adjacent end 98 by the mating of first end cap 32 and end portion 38 of second housing portion 36 adjacent first end cap 32. The bodies 110 and 130, respectively of end cap 32 and end portion 38 are cylindrical and comprise one half of a complete cylinder. End walls 112 and 132 of bodies 110 and 130, respectively are closed except for an aperture to receive the base of hook 40 and the transition of the cap 32 and end portion 38 to end walls 112 and 132, respectively, are tapered as at 33 and 39. The end walls 114 and 134 of bodies 110 and 130, respectively, are open to receive therein end 98 of envelope 26 and thus surrounds and closes end 98.

Figure 3:
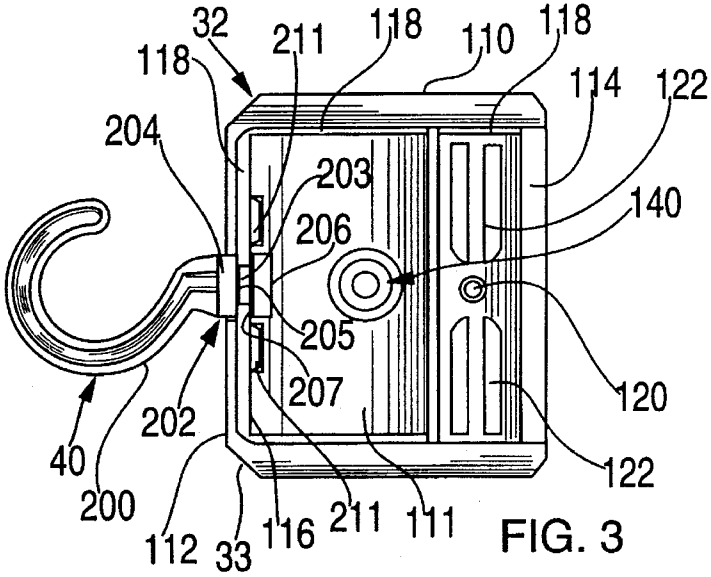
FIG. 3 is a side elevational view of the interior of one end cap of the fluorescent work light of FIG. 1.
Figure 4:
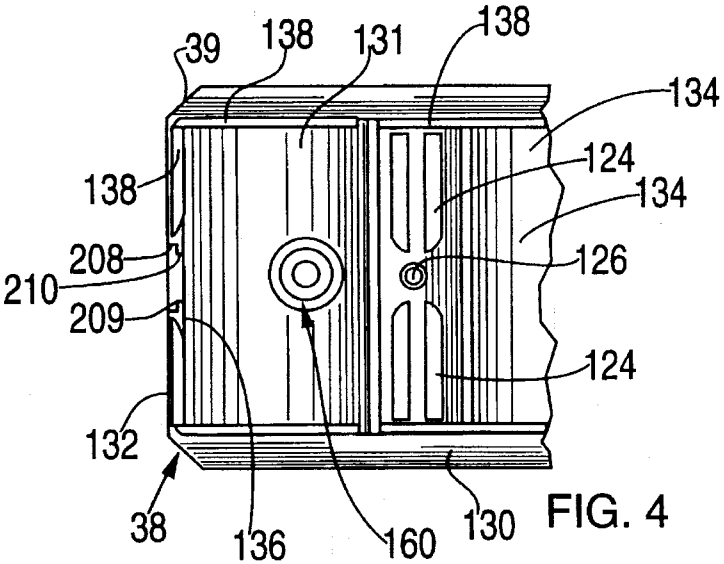
FIG. 4 is a fragmentary side elevation of the interior of the body member that mates with the end cap of FIG. 3.

Hook 40 comprises a hook portion 200, and a base portion 202 made up of outer ring 204 and inner ring 206 separated by a cylindrical extension 203 of a diameter less than both of the rings 204 and 206. In end wall 132 of half 38 is a semi-annular recess 208 of a diameter slightly in excess of the diameter of outer ring 204. It should be understood that when halves 32 and 38 are united the two semi-annular recesses become full, closed recesses. Extending from recess 208 through end wall 132 is a second semi-annular recess 210 having a diameter slightly larger than the diameter of extension 203 but less than the diameter of outer ring 204. With the hook 40 placed in mating half 32 as shown in FIG. 3 and with mating end portion 38 joined to end cap 32, outer ring 204 is captured in recess 208, extension 203 is captured in recess 210 and the inner ring 206 has one surface 207 that engages the inner surfaces 116 and 136 of end walls 112 and 132, respectively. Inner ring 206 is flanked by strengthening and positioning ribs 211 on inner surface 116 of end wall 112. The hook base 204 is now generally enclosed but is free to rotate through a full 360° about the longitudinal axis of work light 20 to provide light at the work site. Hook 40 cannot be removed because of the engagement of surface 207 with the inner surfaces 116 and 136 of end walls 112 and 132, respectively. The hook can not be pushed into the interior of work light 20 due to the engagement of rear face 205 of outer ring 204 with shoulder 209 at the junction of recess 208 with the smaller diameter recess 210.

An assembly ridge 118 extends about most of the outer edge of cavity 111 of end cap 32. The assembly ridge 118 is received in a complimentary recess 138 about the periphery of cavity 131 in end portion 38. The engagement of assembly ridge 118 with recess 138 helps to align end cap 32 with end portion 38 and provides a seal between the halves to prevent the intrusion of dust and moisture or other environmental contaminants into the cavities 111 and 131.

Figure 5:
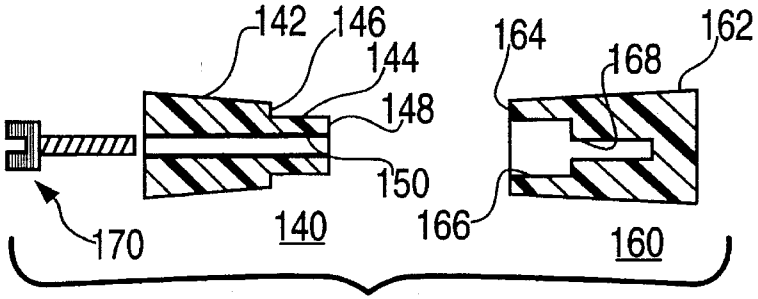
FIG. 5 is a side elevational view in section, of the assembly members of the end cap and body member of FIGS. 3 and 4.

The halves 32 and 38 are assembled to form a circular member which surrounds and closes end 98 of envelope 26 by means of assembly members 140 and 160. Assembly member 140, as shown in the left hand portion of FIG. 5, has a tapered body portion 142 with a cylindrical end portion 144 of lesser diameter than tapered body portion 142 resulting in a shoulder 146. The end face of end portion 144 is a flat surface 148. A bore 150 extends from end face 148 through end portion 144 and the entire body portion 142. Assembly member 160 has a tapered body portion 162, as is seen in the right hand portion of FIG. 5 terminating in a flat face 164. A recess 166 extends from face 164 into body portion 162 a distance approximately equal to the length of cylindrical end portion 144 of assembly member 140. The diameter of recess 166 is slightly smaller than the diameter of cylindrical portion 144 of assembly member 140 to provide an interference fit between cylindrical portion 144 and the walls that define recess 166. A bore 168 extends from recess 166 into body portion 162. A screw 170 of the self taping type having a diameter greater than the diameters of either bore 150 or 168 can be screwed into the walls defining bore 150 and the walls defining bore 168 to lock assembly members 140 and 160 together.

End cap 32 has a raised hub 120 and end portion 38 has a similar raised hub 126. The hubs 120 and 126 enter opposite sides of the aperture 102 adjacent the end 98 of envelope 26 act as stops to fix the position of envelope 26 with respect to the end cap 32 and end portion 38, limit the insertion of envelope 26 into end cap 32 and end portion 38, and keep the envelope 26 from rotating. A series of vents 122 in end cap 32 and a similar series of vents 124 in end portion 38 permit the entry of cooling air into envelope 26 and the escape of hot air from the interior of envelope 26.

Figure 6:
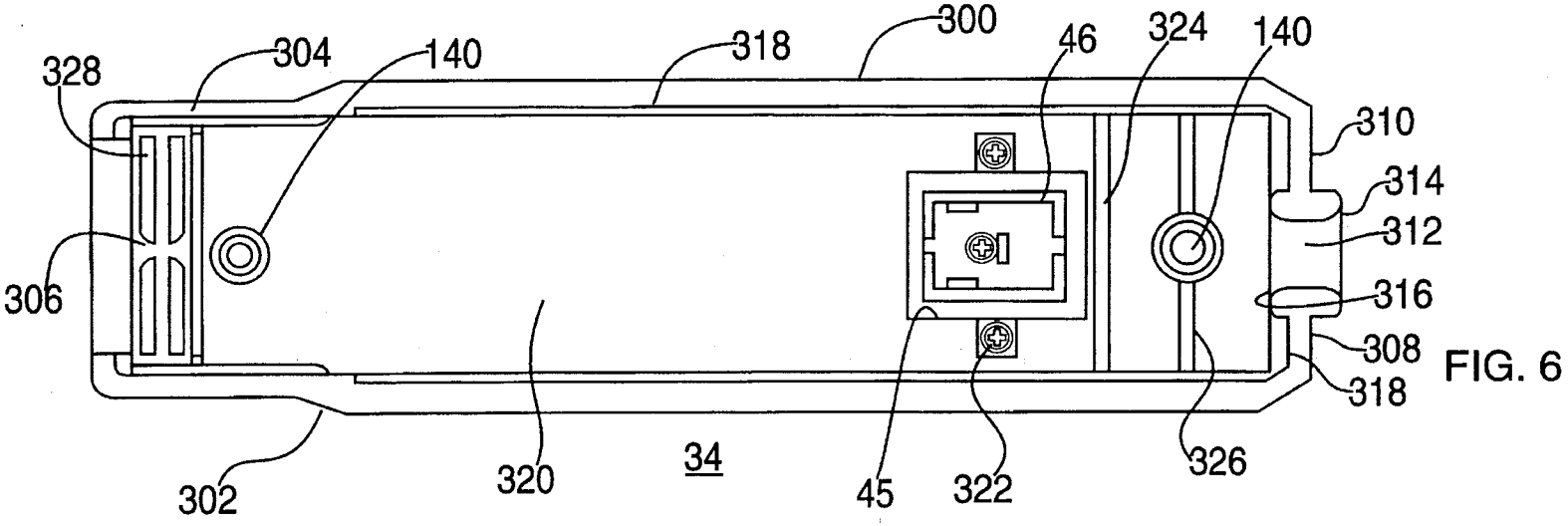
FIG. 6 is a top plan view of the interior of one housing member of the fluorescent work light of FIG. 1.

Turning now to FIG. 6 the interior of second end cap 34 can be described. The exterior surface has a first cylindrical portion 300, a second cylindrical portion 304 of a lesser diameter than portion 300 with a tapered portion 302 between portions 300 and 304. End 306 is open to receive therein the end 100 of envelope 26. End 308 is closed by an end wall 310 which has an aperture 312 therethrough. The diameter of aperture 312 is smaller than the diameter of the three conductor cord 42 to securely grip cord 42 and provide some strain relief. The edges of the wall defining aperture 312 are rounded as at 314 and 316 to prevent injury to the cord 42.

An assembly ridge 318 extends about a substantial portion of cavity 320 to align second end cap 34 with housing end portion 350 and provide a seal as described above. Two assembly members 140 are positioned in cavity 320, one adjacent each of the ends 306 and 308. An aperture 45 is provided for the three prong outlet 46 which is attached to second end cap 34 by fasteners 322.

Extending across the cavity 320 are two walls 324 and 326 which operate with cavities in confronting walls of the housing end portion 350 to provide additional strain relief as will be described below. Wall 324 is adjacent the recess 45 and wall 326 extends from assembly member 140 to the walls of second end portion 34. A series of vents 328 are placed in end cap 34 adjacent end 306 to permit the heat to escape and cooling air to enter.

Figure 7:
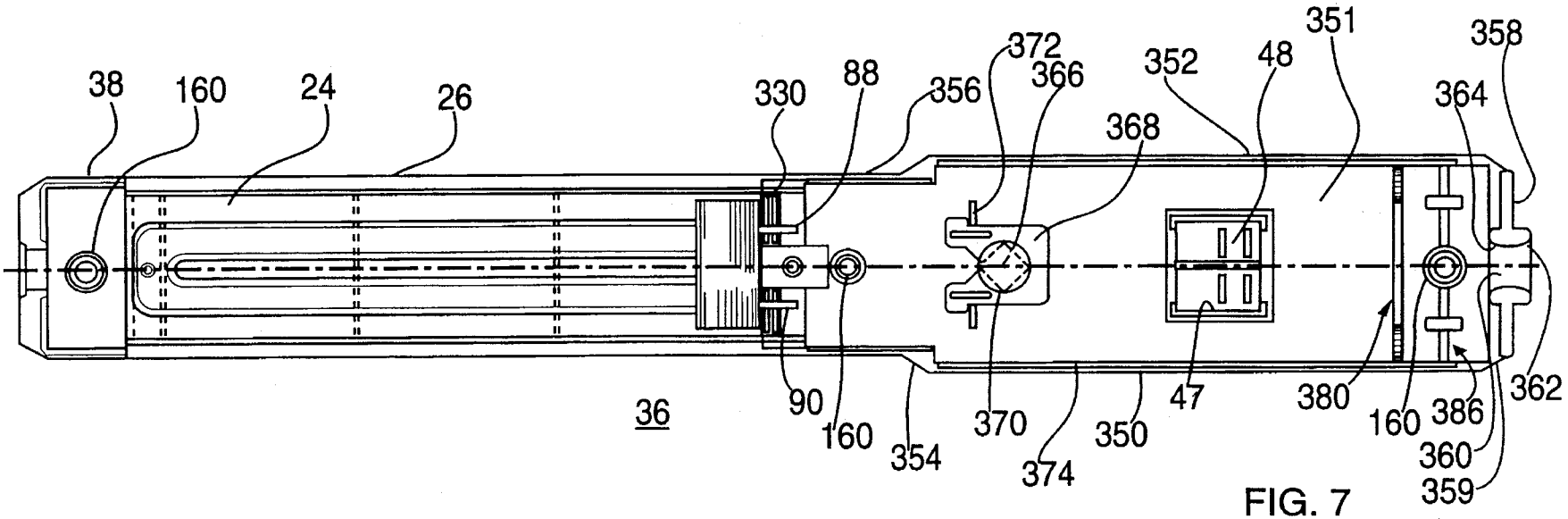
FIG. 7 is a top plan view of the interior of the second housing member which mates with the housing member of FIG. 6.

The housing end portion 350 that cooperates with second end cap 34 is shown in FIG. 7. Portion 350 has a first cylindrical portion 352, a second cylindrical portion 356 of a diameter less than the diameter of portion 352 and a tapered portion 354 therebetween, end wall 358 completely closes cavity 351 except for aperture 360. The walls defining aperture 360 are rounded as at 362 and 364 and the aperture 360 is smaller in diameter than cord 42 to provide strain relief when second end cap 34 is mated with portion 350. The transition from cylindrical portion 352 to end wall 358 is tapered as at 359.

An aperture 47 is provided in portion 350 to receive the on/off switch 48. A further aperture (not visible) permits inside ring 366 of second hook 50 to extend into cavity 351. A retaining clip 368 snaps about the cylindrical extension 370 (shown in dotted line) between inside ring 366 and the wall of cavity 351 and locks against stops 372 so that clip 368 can not be removed or rotated. As shown in FIG. 2, the mount 52 has an outer ring 53 which rests upon the surface of housing end portion 350 and permits mount 52 to be rotated 360° about an axis perpendicular to the longitudinal axis.

Arranged in the inside of cavity 351 are two female assembly members 160. A recess 374 is placed about substantially the entire cavity 351 to receive the alignment and sealing ridge 318 of second end cap 34. Vents 330 are placed in portion 350 of housing portion 36 to permit cooling of the interior of the end portion 350.

Figure 17:
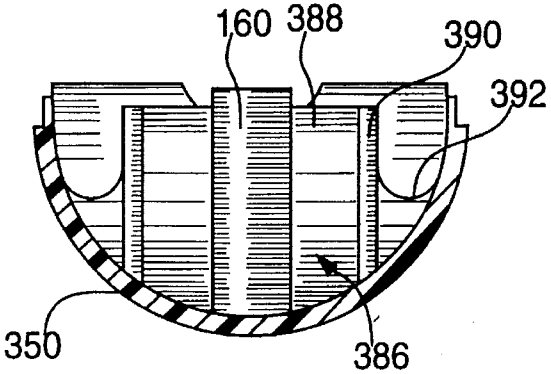
FIG. 17 is a sectional view of the second housing member taken along the line 17—17 of FIG. 14.
Figure 16:
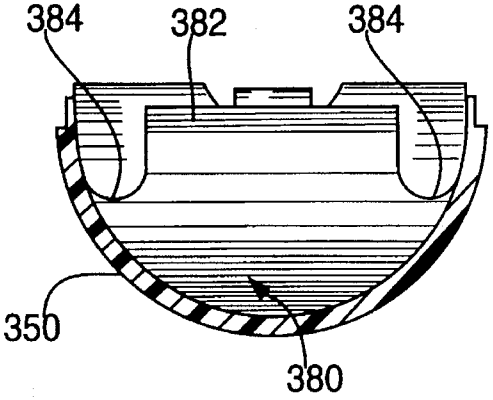
FIG. 16 is a sectional view of the second housing member taken along the line 16—16 of FIG. 14.

A first wall 380 extends across the cavity 351 and has a central portion 382 flanked by recesses 384 as best seen in FIG. 16. The central portion 382 is engaged by wall 324 of second end cap 34 and also extends above the recesses 384 and thus grips the cord 42 inserted therein to provide additional strain relief. A second wall 386 extends from assembly member 160 across cavity 351 in parallel with wall 380. Wall 386, as best seen in FIG. 17 has central portions 388 terminating in transverse enlargements 390. Recesses 392 extend between enlargements 390 and the walls of cavity 351. Transverse walls 326 of second end cap 34 overlie the central portions 388 of wall 386 as well a the recesses 392 to provide further strain relief for the cord 42 passing therethrough.

Figure 14:
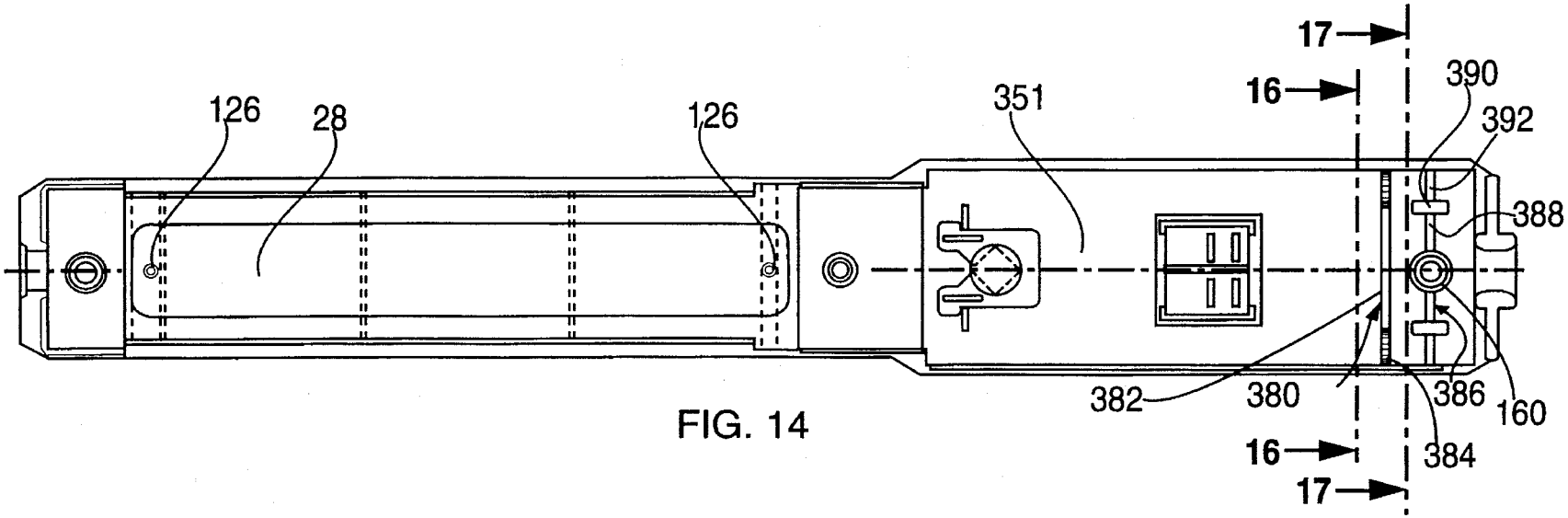
FIG. 14 is a top plan view of the interior of the second housing member of FIG. 7 with the twin-tube assembly removed.

To direct, focus and concentrate the light emitted by tube 24 so that it is most effective, a reflector 28 is attached to housing portion 36 so that it is visible between wall end 114 of first end cap 32 and end 306 of second end cap 34 as is shown in FIG. 14. The reflector 28 is made of a reflective coating upon a cardboard backing and is held in place by hubs 126 adjacent each end. The reflector 28 is curved so that the light can be focused to a given area. Alternatively, the inside surface of envelope 26 could be coated with a reflective material in tape or paint form. The hubs 126, as described above, also enter apertures 102 and 104 to fix the position of envelope 26 and prevent it from rotating.

Figure 15:
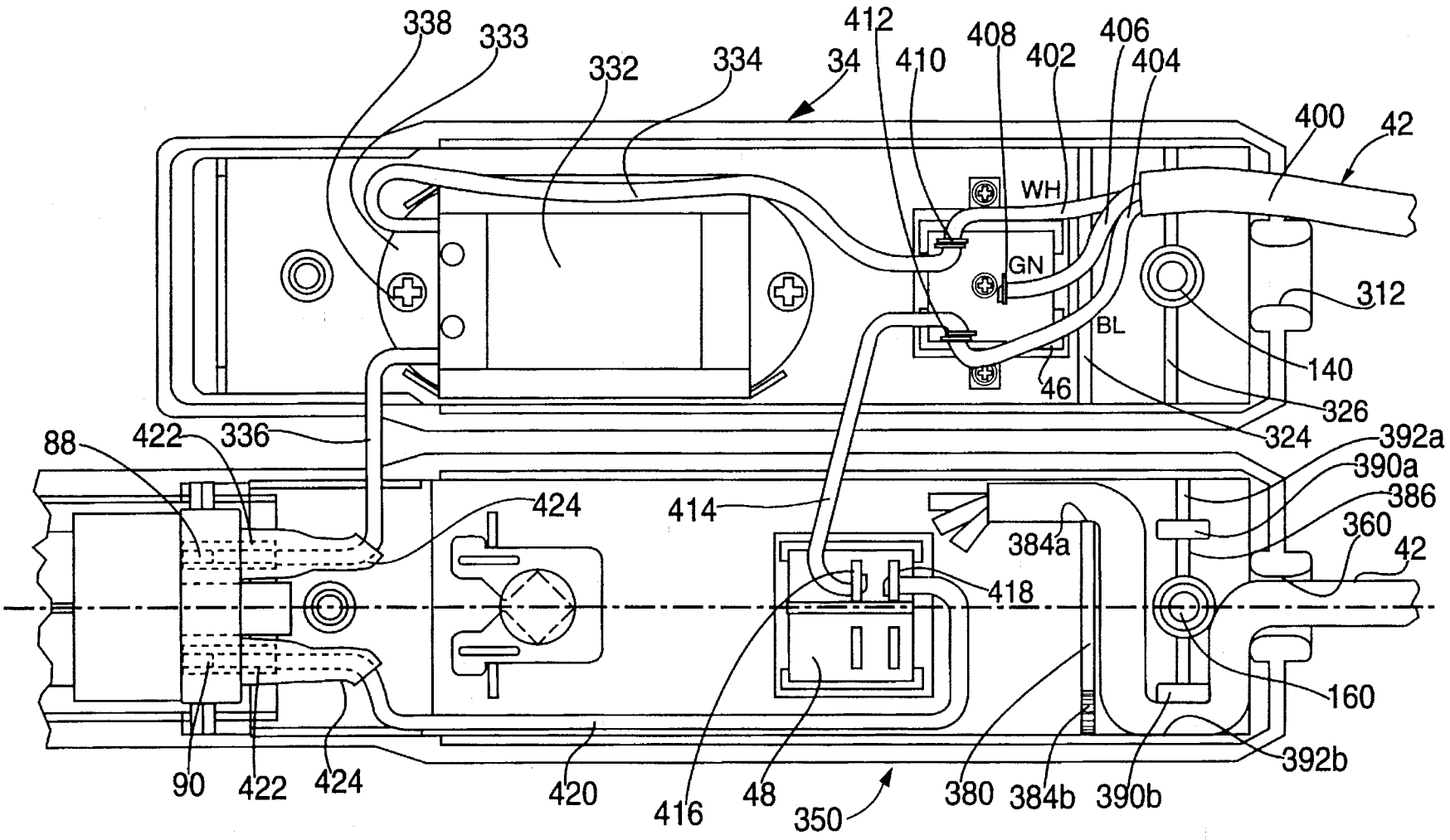
FIG. 15 is a top plan view of the interiors of the first and second housing members of FIGS. 6 and 7 with the wiring installed.

Turning now to FIG. 15 there is shown the interior of second end cap 34 and a fragmentary portion of housing portion 36, namely the interior of portion 350 which is complementary to end cap 34 lying side by side. The three conductor cord 42 is shown with respect to portion 350 in its usual routing to effectuate strain relief, whereas cord 42 shown with respect to end cap 34 is shown with the individual conductors arranged as they would be wired. Only one cord 42 is employed. As shown in the lower portion of FIG. 15, the three conductor cord 42 enters the semi-aperture 360 which is closed by semi-aperture 312, when end cap 34 and housing end portion 350 are assembled. The walls which define the half apertures 312 and 360 form a total aperture smaller in diameter than cord 42 which grasps the cord 42 and provides some strain relief to the cord 42. The cord 42 then passes about one end of enlargement **390*b* on wall 386, through recess, about the other end of enlargement 390*b* between walls 380 and 386, to and through recess 384*a* in wall 380. The cord 42 could also have passed about one end of enlargement 390*a*, through recess 392*a*, about the other end of enlargement 390*a* between walls 380 and 384, to and through recess 384*b* in wall 380. When end cap 34 is assembled to end portion 350, wall 326 will enclose the cord 42 in either recess 392*a* and 392*b* and since the size of recess 392*a* and 392*b* closed by wall 326 is smaller than the cord 42 diameter the cord 42 will be compressed and will thus provide strain relief for cord 42. In a similar fashion, wall 324 of end cap 34, will close either of the recesses 384*a* and 384*b* in wall 380. The size of the closed recess 384*a* and 384*b* is also smaller than the diameter of the cord 42**, compressing it and providing further strain relief.

A portion of the outer jacket 400 of three conductor electrical cord 42 is removed to expose three individually insulated conductors. Conductor 402 has a white insulation jacket, conductor 404 has a black insulation jacket and conductor 406 has a green insulated jacket. The insulation is removed from the ends of conductors 402, 404 and 406 so that they can be soldered to the lugs or connectors of the various devices. The green insulated conductor 406 is attached to the ground terminal 408 of the convenience outlet 46. The white insulated conductor 402 is soldered to terminal 410 which also receives one lead 334 of ballast transformer 332. Ballast transformer 332 is fastened to end cap 34 by means of fasteners 338 extending through apron 333. The second lead 336 of ballast transformer 332 is connected to terminal pin 88 on the leg **24*a* of twin-tube 24, by means of a slide-on sleeve terminal 422 which is insulated by insulating sleeve 424. The black insulated conductor 404 is soldered to terminal 412 of the outlet 46 and connected by lead 414 to terminal 416 of on/off switch 48. The second terminal 418 of on/off switch 48 is connected by conductor 420 to the pin terminal 90 of twin-tube leg 24*b* by means of another slide-on sleeve terminal 422 insulated by insulating sleeve 424**.

Figure 18:
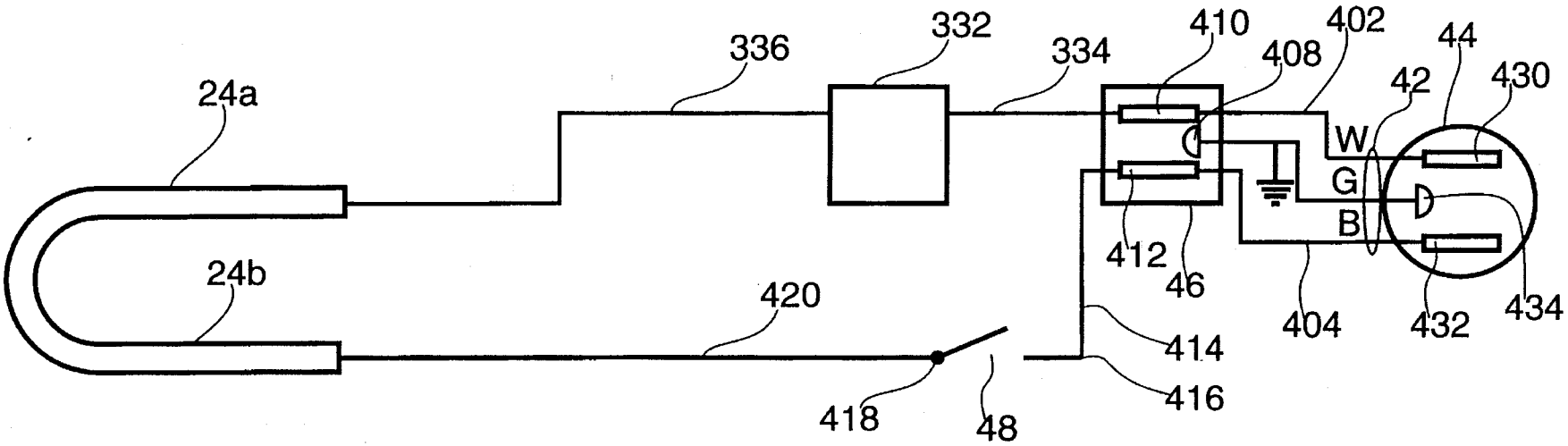
FIG. 18 is an electrical schematic drawing of device of FIG. 1.

The electrical connections described above are shown in schematic form in FIG. 18. Plug 44 having two straight blades 430, 432 and a half-round grounding pin 434 can be plugged into any grounded outlet (not shown) to power the work light 20. Power is available at the convenience outlet 46 immediately and any two blade plug with or without a ground pin can be plugged in and powered. Only when the on/off rocker switch 48 is operated to the on or "1" position will power be provided to twin-tube 24 via the ballast transformer 332. The voltage builds until an arc is struck between the electrodes connected to pins 88 and 90 through the gas in twin tube 24. This creates the free electrons to activate the fluorescent coating of twin tube 24 providing the desired light. Moving rocker switch 48 to its off or "o" position interrupts the flow of current through twin tube 24 and the arc is extinguished turning off twin tube 24.

While there have been shown and described and pointed out the fundamental novel features of the invention as applied to the preferred embodiment, it will be understood that various omissions and substitutions and changes of the form and details of the device illustrated and in its operation may be made by those skilled in the art, without departing from the spirit of the invention.

The embodiments of the invention in which an exclusive property or privilege is claimed are defined as follows:

1. A fluorescent work light assembly comprising:

a) a twin tube fluorescent bulb having two parallel tubes each having a first end and a second end and a first predetermined length between said first and second ends; said tubes joined to one another mechanically and electrically at said second ends and supported by a first insulating support member adjacent said first ends of said tubes and supported by a second insulating support member adjacent said second ends of said tubes;

b) a transparent, substantially cylindrical protective envelope having a passageway therethrough from a first end to a second end and a second predetermined length, longer than said first predetermined length to provide a first extension beyond said first ends of said tubes terminating in a first free end and a second extension beyond said second ends of said tubes terminating in a second free end; a first diametrical bore perpendicular to the longitudinal axis of said tubes, and extending through the walls of said first extension and a second diametrical bore perpendicular to the longitudinal axis of said tubes and extending through the walls of said second extension;

c) said first support member, positioned within said protective envelope adjacent said first end, said first support member having a first aperture therethrough to receive and hold said first ends of said bulb;

d) said second support member positioned within said envelope adjacent said second end, said second support member having a second aperture therethrough to receive and hold said second ends of said bulb;

e) first opaque end cap means comprising two first semi-cylindrical mating sections, each having an open first end and a substantially closed second end, said first sections when mated encircle, at said first sections first ends, said protective envelope adjacent said first free end and at said first sections second end forming a substantially complete first end cap end wall preventing access, through said first end cap, to said passageway of said protective envelope, said first end cap end wall separated from said first free end of said envelope along said longitudinal axis of said tubes and first assembly means coupled to each of said two first sections to hold said first end cap means in assembly about said protective envelope, said first assembly means extending between said two first sections at a location intermediate said first and second ends of said first end cap means sections;

f) second opaque end cap means comprising two second semi-cylindrical mating sections, each having an open third end and a substantially closed fourth end, said second sections when mated encircle, at said second sections third ends, said protective envelope adjacent said second free end and at said second sections fourth ends forming a substantially complete second end cap end wall preventing access, through said second end cap, to said passageway of said protective envelope, said second end cap end wall separated from said second free end of said envelope said longitudinal axis of said tubes and second assembly means coupled to each of said two second sections to hold said second end cap means in assembly about said protective envelope, said second assembly means extending between said two second sections at a location intermediate said third and fourth ends of said second end cap sections;

g) a single contact pin for each tube located at said first end of said tubes, said contact pins extending beyond said first support member and adapted to be connected to a source of power to light said fluorescent bulb; and h) power supply means connected to said contact pins to selectively apply electrical power to said contact pins to cause said fluorescent bulb to light.

2. A fluorescent work light assembly as defined in claim 1, further comprising:

a) an opaque semi-cylindrical body member having an interior surface and adapted to be positioned adjacent said protective envelope in line with one of said two first semi-cylindrical sections and one of said two second semi-cylindrical sections to form a continuous opaque housing member from said first end cap to said second end cap with said body member therebetween to occlude a portion of said transparent envelope;

b) a reflective means positioned on said interior surface of said semi-cylindrical body member and aligned with said opaque housing member to direct, focus and concentrate the light given off by said twin tube fluorescent bulb through a non-occluded portion of said protective envelope.

3. A fluorescent work light assembly as defined in claim 2, wherein said reflective means extends along said envelope for a distance substantially equal to said first predetermined length.

4. A fluorescent work light assembly as defined in claim 3, wherein said reflective means is curved to substantially match the curve of said envelope.

5. A fluorescent work light assembly as defined in claim 3, wherein said reflective means is comprised of a reflective film placed on a backing member.

6. A fluorescent work light assembly as defined in claim 2, wherein said reflective means is curved to substantially match the curve of said cylindrical envelope.

7. A fluorescent work light assembly as defined in claim 6, wherein said reflective means is comprised of reflective film placed on a backing member.

8. A fluorescent work light assembly as defined in claim 2, wherein said reflective means is comprised of a reflective film placed on a backing member.

9. A fluorescent work light assembly as defined in claim 2, wherein substantially half of said interior surface of said housing member for the entire length thereof is coated with a reflective material.

10. A fluorescent work light assembly as defined in claim 9, wherein said reflective material is a paint.

11. A fluorescent work light assembly as defined in claim 1, wherein said substantially cylindrical protective envelope has an outer cylindrical surface and substantially half of said outer cylindrical surface of said protective envelope from said first end to said second end is adjacent reflective material.

12. A fluorescent work light assembly as defined in claim 11, wherein said reflective material is a paint.

13. A fluorescent work light assembly as defined in claim 11, wherein said reflective material is a metal foil.

14. A fluorescent work light assembly as defined in claim 11, wherein said reflective material is a metal foil.

15. A fluorescent work light assembly as defined in claim 1, wherein said power supply means comprises: a two position switch in series with a source of AC current to permit the flow of current to said contact pins of said bulb when said switch is in a second position.

16. A fluorescent work light assembly as defined claim 15, wherein said power supply means further comprises ballast means.

17. A fluorescent work light assembly as defined in claim 1, wherein said power supply means comprises: a two position switch in series with a source of AC current to permit the flow of current to said contact pins of said bulb when said switch is in a second position.

18. A fluorescent work light assembly as defined claim 17, wherein said power supply means further comprises ballast means.

19. A fluorescent work light assembly comprising:

a) a twin tube fluorescent bulb having two parallel tubes each having a first end and a second end and a first predetermined length between said first and second ends; said tubes joined to one another mechanically and electrically at said second ends and supported by an insulating support member adjacent said first ends; each of said two tubes having an electrical contact pin at said first end, said contact pin extending beyond said support member for engagement with an electrical conductor, b) a protective envelope having a passageway therethrough from a first end to a second end and having a second predetermined length longer than said first predetermined length;

c) additional support member positionable within said protective envelope adjacent said second ends of said bulb, said additional support member having an additional aperture therethrough to receive and hold said second ends of said bulb;

d) said second support means positionable within said protective envelope adjacent said first end, said support means having an second aperture therethrough to receive and hold said support member and permitting access to said contact pins;

e) power supply means connected to said contact pins to selectively apply electrical power to said contact pins to cause said fluorescent bulb to light;

f) first end cap means comprising:

g) first and second mating sections which when mated encircle a portion of said protective envelope adjacent said envelope second end and substantially close said passageway at said second end;

h) said second mating section having a second assembly member terminating in a socket and having a bore therethrough;

i) said first mating section having a first assembly member terminating in a cylindrical portion dimensioned to enter said socket of said second assembly member and having a bore therethrough;

j) said second mating section positioned adjacent said second end of said envelope with said second assembly member in a location beyond said second free end of said envelope and said first mating section positioned adjacent said second end of said envelope with said first assembly member in a location beyond said second free end of said envelope with said cylindrical portion entering said socket of said second assembly member; and k) fastening means in said bore of said first and second assembly members to hold in assembly said first and second mating sections.

20. A fluorescent work light assembly as defined in claim 19, wherein said first and second mating sections of said second end cap means have a stop means therein which limits the insertion of said second end of said envelope into said second end cap means.

21. A fluorescent work light assembly as defined in claim 19, wherein said first end cap means comprises: an end wall to substantially close said passageway; an aperture through said end wall; and suspension means extending through said aperture through said end wall whereby said fluorescent work light assembly can be suspended adjacent a work area.

22. A fluorescent work light assembly as defined in claim 21, wherein said suspension means is free to rotate 360° with respect to its longitudinal axis to permit the work light assembly to be correctly positioned with respect to a work area.

23. A fluorescent work light assembly comprising:

a) a twin tube fluorescent bulb having two parallel tubes each having a first end and a second end and a first predetermined length between said first and second ends; said tubes joined to one another mechanically and electrically at said second ends and supported by a first insulating support member adjacent said first ends of said tubes; each of said two tubes having an electrical contact pin at said first end of said tubes, said contact pin extending beyond said first support member for engagement with an electrical conductor;

b) a transparent, substantially cylindrical protective envelope having a passageway therethrough from a first end to a second end and having a second predetermined length longer than said first predetermined length, to provide a first extension beyond said first ends of said tubes terminating in a first free end and a second extension beyond said second ends of said tubes terminating in a second free end; a first diametrical bore perpendicular to the longitudinal axis of said tubes, and extending through the walls of said first extension and a second diametrical bore perpendicular to the longitudinal axis of said tubes and extending through the walls of said second extension;

c) a second support member positionable within said protective envelope adjacent said second end of said envelope, said second support member having a first aperture therethrough to receive and hold said second ends of said tubes;

d) said first support member positionable within said protective envelope adjacent said first end of said envelope, said first support member having a second aperture therethrough to receive and hold said first ends of said tubes and permitting access to said contact pins;

e) power supply means connected to said contact pins to selectively apply electrical power to said contact pins to cause said fluorescent bulb to light;

f) first end cap means comprising:

g) first and second mating sections, each having an open first end and a substantially closed second end, said first and second mating sections when mated encircle, at said first ends of said first and second mating sections, said protective envelope adjacent said envelope first free end and at said second ends of said first and second mating sections forming a substantially complete first end cap end wall preventing access through said first end cap means, to said passageway at said first free end;

h) said second mating section having at least one second assembly member, each of said at least one second assembly member terminating in a socket and having a bore therein;

i) said first mating section having at least one first assembly member, each of said at least one first assembly member terminating in a cylindrical portion dimensioned and positioned to enter said socket of said associated one of said at least one second assembly member and having a bore therethrough, said at least one of said first assembly member extending towards said second mating section in the space between said first free end of said envelope and said first end cap end wall;

j) said second mating section having at least one of said second assembly member extending towards said first mating section in the space between said first free end of said envelope and said first end cap end wall said cylindrical portion of said at least one of said first assembly member entering said socket of said associated one of said at least one second assembly member, when said first and second mating sections are mated; and k) fastening means in said bores of said at least one first and associated at least one second assembly members to hold in assembly said first and second mating sections.

24. A fluorescent work light assembly as defined in claim 23, wherein said first and second mating sections have a stop means therein which limits the insertion of said first end of said envelope into said first end cap means.

25. A fluorescent work light assembly as defined in claim 23, wherein said first end cap means comprises:

an aperture through said first end cap end wall dimensioned to grip an electrical cord passing through said aperture into said first end cap means.

26. A fluorescent work light assembly comprising:

a) a twin tube fluorescent bulb having two parallel tubes each having a first end and a second end and a first predetermined length between said first and second ends; said tubes joined to one another mechanically and electrically at said second ends and supported by a first insulating support member adjacent said first ends of said tubes; each of said two tubes having an electrical contact pin at said first end of said tubes, said contact pin extending beyond said first support member for engagement with an electrical conductor;

b) a transparent, substantially cylindrical protective envelope having a passageway therethrough from a first end to a second end and having a second predetermined length longer than said first predetermined length, to provide a first extension beyond said first ends of said tubes terminating in a first free end and a second extension beyond said second ends of said tubes terminating in a second free end; a first diametrical bore perpendicular to the longitudinal axis of said tubes and extending through the walls of said first extension and a second diametrical bore perpendicular to the longitudinal axis of said tubes and extending through the walls of said second extension;

c) a second support member positionable within said protective envelope adjacent said second end of said envelope, said second support member having a first aperture therethrough to receive and hold said second ends of said tubes;

d) said first support member positionable within said protective envelope adjacent said first end of said envelope, said first support member having a second aperture therethrough to receive and hold said first ends of said tubes and permitting access to said contact pins;

e) power supply means connected to said contact pins to selectively apply electrical power to said contact pins to cause said fluorescent bulb to light;

f) first end cap means comprising:

g) first and second mating sections, each having an open first end and a substantially closed second end, said first and second mating sections when mated encircle, at said first ends of said first and second mating sections, said protective envelope adjacent said envelope first free end and at said second ends of said first and second mating sections forming a substantially complete first end cap end wall preventing access, through said first end cap means, to said passageway at said first free end;

h) said second mating section having at least one second assembly member, each of said at least one second assembly member terminating in a socket and having a bore therein;

i) said first mating section having at least one first assembly member, each of said at least one first assembly member terminating in a cylindrical portion dimensioned and positioned to enter said socket of said associated second assembly member and having a bore therethrough, said at least one of said first assembly member extending towards said second mating section in the space between said first free end of said envelope and said first end cap end wall;

j) said second mating section having at least one of said second assembly member, extending towards said first mating section in the space between said first free end of said envelope and said first end cap end wall said cylindrical portion of said at least one of said first assembly member entering said socket of said associated one of said at least one second assembly member, when said first and second mating sections are mated;

k) first fastening means in said bores of each of said at least one first and associated at least one second assembly member to hold in assembly said first and second mating sections;

l) second end cap means comprising:

m) third and fourth mating sections, each having an open third end and a substantially closed fourth end, said third and fourth mating sections when mated encircle, at said third ends of said third and fourth mating sections, said protective envelope adjacent said envelope second free end and at said fourth ends of said third and fourth mating sections forming a substantially complete second end cap end wall preventing access, through said second end cap means, to said passageway at said second free end;

n) said fourth mating section having at least one fourth assembly member, each of said at least one fourth assembly member terminating in a socket and having a bore therein;

o) said third mating section having at least one third assembly member, each of said at least one third assembly member terminating in a cylindrical portion dimensioned and positioned to enter said socket of said associated one of said at least one fourth assembly member and having a bore therethrough, said at least one of said third assembly member extending towards said fourth mating section in the space between said second free end of said envelope and said second end cap wall;

p) said fourth mating section having at least one of said fourth assembly member extending towards said third mating section in the space between said second free end of said envelope and said second end cap end wall said cylindrical portion of said at least one of said third assembly member entering said socket of said associated one of said at least one fourth assembly member; and q) second fastening means in said bores of each of said at least one said third and fourth assembly means to hold in assembly said third and fourth mating sections.

27. A fluorescent work light assembly as defined in claim 26, wherein said first and second mating sections have a first stop means therein which limits the insertion of said first end of said envelope within said first end cap means, and said third and fourth mating members have a second stop means therein which limits the insertion of said second end of said envelope within said second end cap means.

28. A fluorescent work light assembly as defined in claim 27, wherein said power supply means comprises a two position switch in series with a source of AC current to permit the flow of current to said contact pins of said bulb when said switch is in a first position and prevents the flowing of current to said contact pins of said bulb when said switch is in a second position.

29. A fluorescent work light assembly as defined in claim 28, wherein said power supply means further comprises a ballast means.

30. A fluorescent work light assembly as defined in claim 26, wherein said second end cap means comprises:

a) an aperture through said second end cap end wall; and b) suspension means extending through said aperture through said second end cap end wall to permit said fluorescent work light assembly to be suspended adjacent a work area.

31. A fluorescent work light assembly as defined in claim 30, wherein said suspension means is free to rotate 360° with respect to its longitudinal axis to permit the work light assembly to be correctly positioned with respect to a work area.

32. A fluorescent work light assembly as defined in claim 26, wherein said first end cap means comprises:

an aperture through said first end cap end wall dimensioned to grip an electrical cord passing through said aperture into said first end cap means.

33. A fluorescent work light assembly comprising:

a) a twin tube fluorescent bulb having two parallel tubes each having a first end and a second end and a first predetermined length between said first and second ends; said tubes joined to one another mechanically and electrically at said second ends and supported by a first insulating support member adjacent said first ends and supported by a second insulating support member adjacent said second end; each of said two tubes having an electrical contact pin at said first end, said contact pin extending beyond said first support member for engagement with an electrical conductor for applying electric power to said contact pins to cause said fluorescent bulb to operate and produce visible light;

b) a transparent, substantially cylindrical protective envelope having a passageway therethrough from a first end to a second end and a second predetermined length longer than said first predetermined length whereby when said bulb is centered along said envelope length, both of said first and second insulating supports are in said envelope, and a first extension of said envelope extends beyond said first ends of said bulb while a second extension of said envelope extends beyond said second ends of said bulb, said envelope has an outer cylindrical surface and an inner cylindrical surface;

c) a first set of apertures in said first extension, said first apertures arranged along a radial axis perpendicular to the longitudinal axis of said envelope;

d) a second set of apertures in said second extension, said second apertures arranged along a radial axis perpendicular to the longitudinal axis of said envelope;

e) a first substantially hollow, semi-circular mating housing member having a third predetermined length longer than said second predetermined length and when positioned on said envelope covers approximately fifty percent of the outer surface of said envelope along the length of said envelope, said first housing member having a curved interior surface and an exterior surface;

f) a second, substantially hollow, semi-circular mating housing member having an interior surface which when mated to said first housing member adjacent said first extension and said first end of said envelope completely encircles said first extension and said first end of said envelope;

g) a third, substantially hollow, semi-circular mating housing member having an interior surface which when mated to said first housing member adjacent said second extension and said second end of said envelope completely encircles said second extension and said second end of said envelope; the portion of said outer surface of said envelope not covered by said first, said second and said third housing members defines a window having an area equal to approximately fifty percent of said envelope outer surface for the transmission of light from said bulb to the area about said assembly;

h) reflective means applied in the interior surface of said first housing member aligned with said window to direct, focus and concentrate light given off by said bulb at said window; and i) means to prevent rotation of said protective envelope with respect to said reflective means which can alter the amount of light available at said window.

34. A fluorescent work light assembly as defined in claim 33, wherein said means to prevent rotation of said protective envelope with respect to said reflective means is a plurality of pins on at least one of said first, second and third housing members which enter at least one of said first and at least one of said second sets of apertures in said envelope.

35. A fluorescent work light assembly as defined in claim 34, wherein said reflective means is comprised of a reflective film placed on a backing member.

36. A fluorescent work light assembly as defined in claim 33, wherein said means to prevent rotation of said protective envelope with respect to said reflective means comprises:

two pins on the interior surface of said first housing member, each pin entering an associated one of said first and second pairs of apertures in said envelope.

37. A fluorescent work light assembly as defined in claim 36 further comprising:

a) a first pin on said interior surface of said second housing member to enter the second of said first pair of apertures in said envelope; and b) a second pin on said interior surface of said third housing member to enter the second of said second pairs of apertures in said envelope.

38. A fluorescent work light assembly as defined in claim 37, wherein said reflective means is curved to substantially match the curve of interior surface of said housing member.

39. A fluorescent work light assembly as defined in claim 37, wherein said reflective means is comprised of reflective film placed on a backing member.

40. A fluorescent work light assembly as defined in claim 33, wherein said reflective means extends along the interior surface of said first housing member for a distance substantially equal to said first predetermined length.

41. A fluorescent work light assembly as defined in claim 33, wherein said reflective means is curved to substantially match the curve of said interior surface of said first housing member.

42. A fluorescent work light assembly as defined in claim 33, wherein said reflective means is comprised of a reflective film placed on a backing member.

* * * * *